US005980357A

United States Patent [19]

Newby

[11] Patent Number: 5,980,357

[45] Date of Patent: Nov. 9, 1999

[54] PUPPET CONTROLLED FROM ABOVE

[76] Inventor: Thomas O. Newby, 48 Kingsridge Ct., RD #10, Kent Lakes, N.Y. 10512

[21] Appl. No.: 09/021,982

[22] Filed: Feb. 11, 1998

[51] Int. Cl.[6] ..... A63J 19/00; A63H 3/20

[52] U.S. Cl. ..... 446/366; 446/367; 446/359

[58] Field of Search ..... 446/366, 367, 446/365, 314, 363, 362, 361, 359, 330, 329, 327

[56] References Cited

U.S. PATENT DOCUMENTS

| | | | |
|---|---|---|---|
| 1,350,711 | 8/1920 | Dondo | 446/367 |
| 2,466,214 | 4/1949 | Deaton | 446/366 X |
| 2,862,331 | 12/1958 | Oppenheimer | 446/359 |
| 4,179,843 | 12/1979 | Ho | 446/363 |

FOREIGN PATENT DOCUMENTS

| | | | |
|---|---|---|---|
| 1265635 | 4/1968 | Germany | 446/366 |
| 21268 | 1/1900 | United Kingdom | 446/367 |
| 607026 | 8/1948 | United Kingdom | 446/362 |
| 1048218 | 11/1966 | United Kingdom | 446/363 |
| 2020558 | 11/1979 | United Kingdom | 446/363 |
| 2215224 | 9/1989 | United Kingdom | 446/361 |

*Primary Examiner*—D. Neal Muir
*Attorney, Agent, or Firm*—F. Brice Faller

[57] ABSTRACT

Apparatus for animating a figure includes a head pivotably connected to a body, a control rod having a lower end fixed in the head and an upper end pivotable about an axis through a handle, and a second rod suspending the body from the handle remotely from the pivot axis, whereby pivoting the control rod about the pivot axis causes the head to pivot with respect to the body, giving the appearance of a change in posture. The head is preferably mounted for universal movement with respect to the body, and the rod is mounted for rotation with respect to the handle about a longitudinal rod axis which is perpendicular to the pivot axis. Rotating the control rod thus causes the head to rotate with respect to the body, giving the impression of looking left and right.

13 Claims, 5 Drawing Sheets

PUPPET CONTROLLED FROM ABOVE

BACKGROUND OF THE INVENTION

This invention relates to animated figures, in particular to puppets that are controlled from above.

Puppets can be categorized into four different groups. The first group includes puppets designed to be manipulated on the hand or fingers. The second includes puppets controlled from within, behind, or underneath with rods and/or mechanical actuators. The third includes two dimensional jointed figures and shadow puppets. The fourth, to which the present invention appertains, includes puppets controlled from above. This group includes puppets controlled with strings (marionettes), and puppets controlled with rods, known as Roman or Sicilian puppets.

Marionettes generally utilize a rigid structure from which a jointed figure is suspended by strings. The figure is animated by artfully manipulating the strings from above to lift and lower parts of the figure to which the strings are attached. Great skill is required to produce a balanced and pleasing effect. In the hands of an untrained user the figure appears to simply swing around and bob aimlessly. In addition the strings are easily tangled, especially when improperly handled or stored. Marionettes in the hands of younger children often become irreparably knotted. As a toy, they are usually short-lived.

Roman or Sicilian style puppets have a rigid rod fixed to the head and extending vertically to a cylindrical handle having a hook which suspends it from a horizontal bar. A second rod is often used to control a sword, and is tied to the first rod near the handle. In a variation of the Sicilian puppet occasionally adopted for use as a toy, a string for manipulating the hands is draped from the hook. Articulation of this type of puppet is limited. Although appropriate for the very stylized and combative nature of traditional Sicilian puppet dramas, the controls offer very little of the subtle positioning of the head and body obtainable with a marionette. An unskilled performer can do little more than bob the characters around and bash them into each other.

For general usage and particularly for children the existing overhead puppets do not offer an acceptable combination of ease of use, performability, and durability. As a result these puppets appear far less frequently in the toy market than the other varieties.

SUMMARY OF THE INVENTION

According to the invention, a figure to be animated includes a head pivotably connected to a body. A control rod fixed to the head extends upward to a control handle where it is mounted for pivoting movement about a pivot axis through the handle, while the body is suspended from the handle remotely from the pivot axis, preferably by a second rod which is pivotably attached at both the body and the handle. Thus, when the control rod is pivoted about the pivot axis, the head pivots with respect to the body.

According to a preferred embodiment, the head is mounted for universal movement with respect to the body, and the control rod is mounted for rotation with respect to the control handle about a longitudinal rod axis. This is preferably accomplished by providing a vertical slot in the control handle, and mounting a pin transversely through the slot, the pin being journaled in the handle for rotation about the pivot axis. The pin is provided with a diametric hole which receives the control rod therethrough for rotation about the longitudinal axis. Rotating the rod therefore causes the head to rotate with respect to the body, in addition to being pivotable with respect to the body.

The two degrees of freedom provided by the arrangement of the control rod in the handle enable the user to impart a lifelike movement to the figure with a minimum of experience and skill, making it suitable for use as a children's toy. The combination of of rigid members and pivoting joints employing hard and soft materials in the preferred embodiment causes the figure to assume a lifelike stance without any effort by the operator.

The puppet control system according to the invention is very responsive and capable of providing a variety of expressive movements in the figure. Unlike marionettes or Roman puppets, the use of parallel rigid rods allows for a very controllable twisting action of the head relative to the body. The rigidity of the rods causes the body and the head to be relatively repositioned according to the pitch of the control rod, i.e., the pivot angle with respect to the handle. The figure can undergo a variety of balanced and expressive motions by additionally changing the attitude of the control handle relative to the ground and twisting the control knob with the thumb and forefinger. Since this can all be accomplished with one hand, the puppeteer can manipulate appendages on the figure with the other hand. This amount of direct control is not possible in any of the existing overhead suspension puppets.

The puppet according to the invention is less vulnerable to entanglement than standard marionette style puppets. The principal suspension members are two rigid wires which hold the figure at a consistent distance from the control handle. Unlike the marionette, which employs from four to twelve strings, the wires will not become entangled when improperly handled. According to a preferred embodiment, a single string attached to appendages at either end is looped through forks on the handle for imparting motion to the appendages. This is arranged so that it is easy to maintain and unlikely to become entangled.

It should be recognized that the principles of the invention do not limit it to manual operation of a puppet. The information necessary to manipulate the puppet can be remotely generated by sensors attached to the physical structure of the invention or externally positioned to track the relative position of the structure, and can be used to operate a puppet remotely by means of servo-mechanisms. Likewise the information can be used to animate a transitory object or image such as a digitally generated character. This can be accomplished by any one of a variety of motion tracking systems.

These and other objects and advantages of the invention will be apparent to one skilled in the arts of puppetry and animation from the drawings and detailed description which follow.

DETAILED DESCRIPTION OF THE PREFERRED EMBODIMENTS

Figure 1:
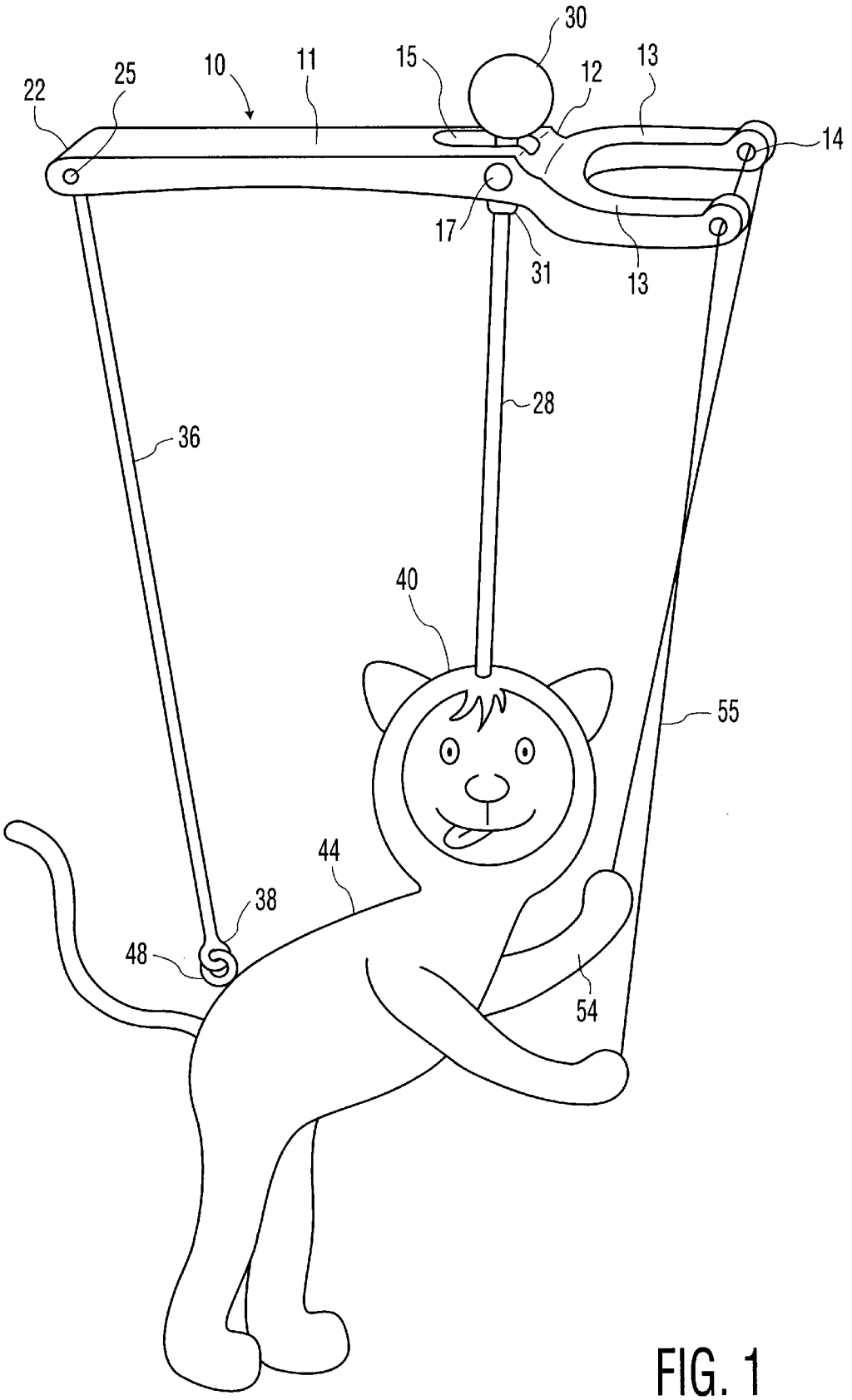
FIG. 1 is a perspective view of an embodiment of the puppet according to the invention.

Referring to FIG. 1, the puppet includes a head 40 fixed to control rod 28, a body 44 suspended by a second rod 36, forward limbs 54 suspended by the ends of a looped string 55, and rear limbswhich dangle from the body 44. The control rod 28 extends through a slot 15 in the handle 10, where it is pivotable about a pivot axis which is coaxial with a pin 17 extending transversely through the slot. Pivoting movement of the control rod 28 is effected by manually moving a knob 30 at the top end of the rod, thereby causing the head 40 and the body 44 to move forward or backward. The second rod 36 is pivotable about a pin 25 at the rear end 22 of the handle 10,and is also pivotable at its bottom end by virtue of a bottom eye 38 which is looped through an eye screw 48 in the body. Moving the knob 30 not only moves the head and body forward or backward, but also changes the angle of the head relative to the body, thus giving the impression of a change in posture. Further, the rod is rotatable about its longitudinal axis by virtue of a sliding fit through a transverse hole in the pin 17, whereby the head 40 may be rotated to give the impression of the puppet looking to the right or left. The front end 12 of the handle 10 is provided with a pair of forks 13 having holes 14 receiving string 55 at their distal ends. Pulling on the string gives motion to the limbs 54.

Figure 2:
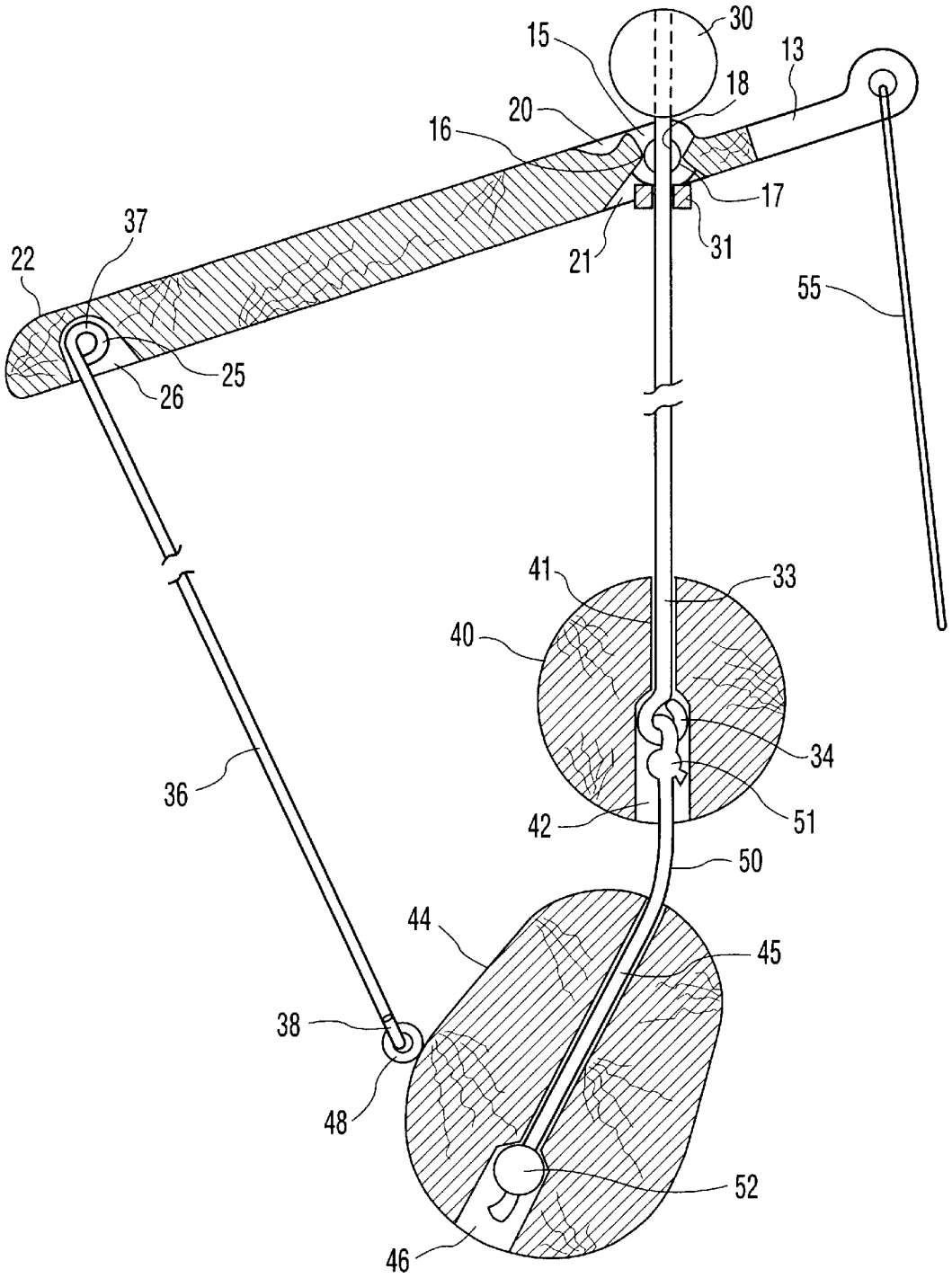
FIG. 2 is a cross section of a first construction of puppet according to the invention.

The construction of the puppet is shown in greater detail in the cross section of FIG. 2. Here the head 40 and body 44 are fabricated from wood, as would be suitable for puppets of limited production. The head 40 is provided with a radial bore 41 which is diametrically opposed from a radial channel 42 of somewhat larger size. The lower end 33 of control rod 28 is provided with an eye 34 to which a flexible cord 50 is tied at knot 51. The head is assembled by sliding the rod 28 through the bore 41 until the eye 34 bottoms out and the knot 51 lodges in the channel 42 as shown. The other end of cord 50 is then slid through a longitudinal bore 45 in body 44, and provided with a knot 46 which is lodged in a channel 46 at the end of the bore 45. Rod 28 is provided with a stop collar 31 which is fixed in place by a small screw, and the upper end 29 of the control rod 28 is received through a hole 18 in the pin 17 transverse to the pivot axis. The pin 17 is journaled in a transverse bore 16 which intersects slot 15 through the handle. The knob 30 is fitted to the upper end 29 by a press fit or screw threads. A top recess 20 and a bottom recess 21 in the handle receive the knob 30 and the stop collar 31, respectively, to permit a smooth action. The bottom eye 38 on the second rod is formed on the eye screw 48 which is then screwed into the body 44. The top eye 37 is received in a slot 26 in the rear end of the handle 10, and the pin 25 is pressed in place in the handle through eye 38.

Figure 3A:
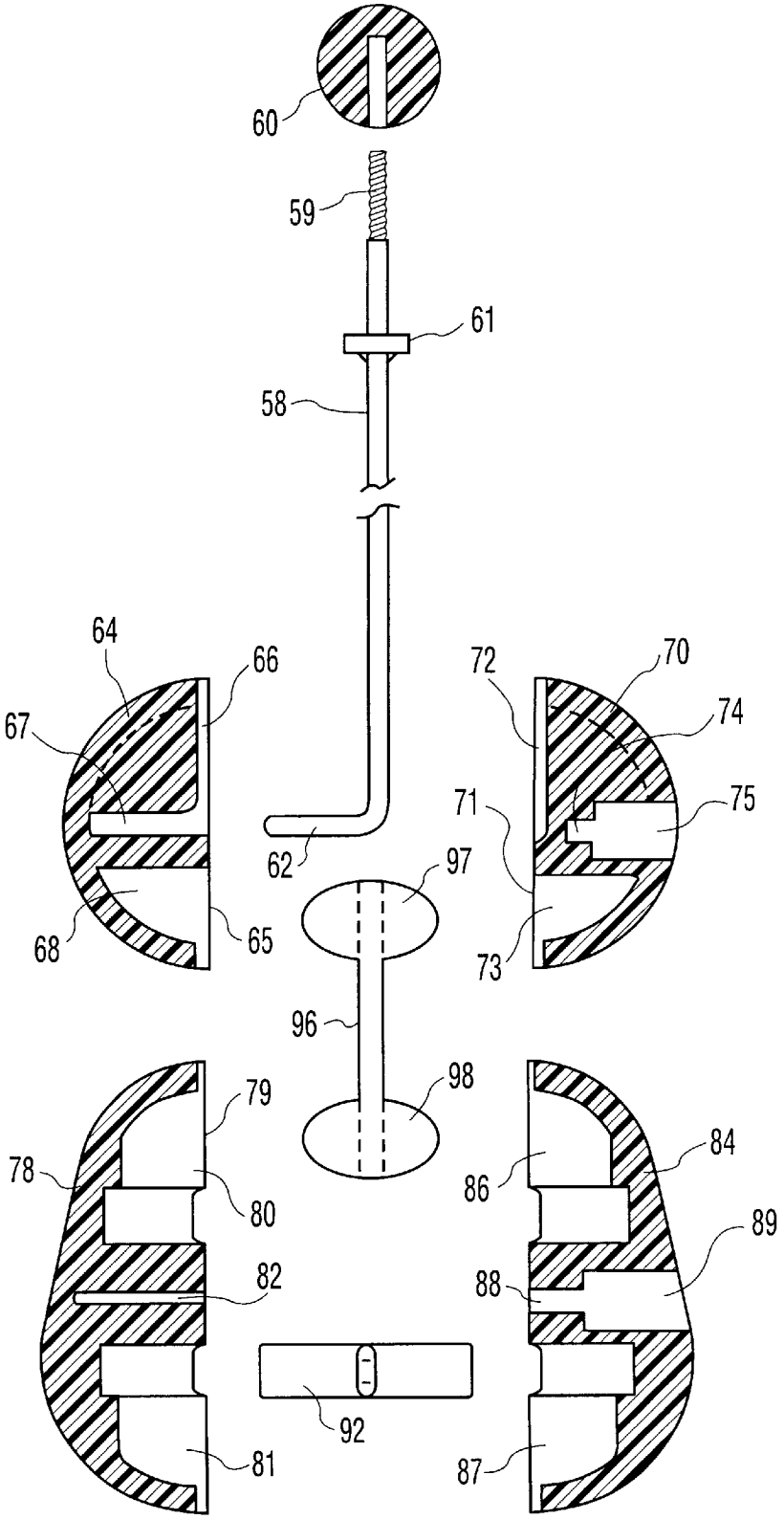
FIG. 3A is an exploded and section of a second construction of the puppet.
Figure 3B:
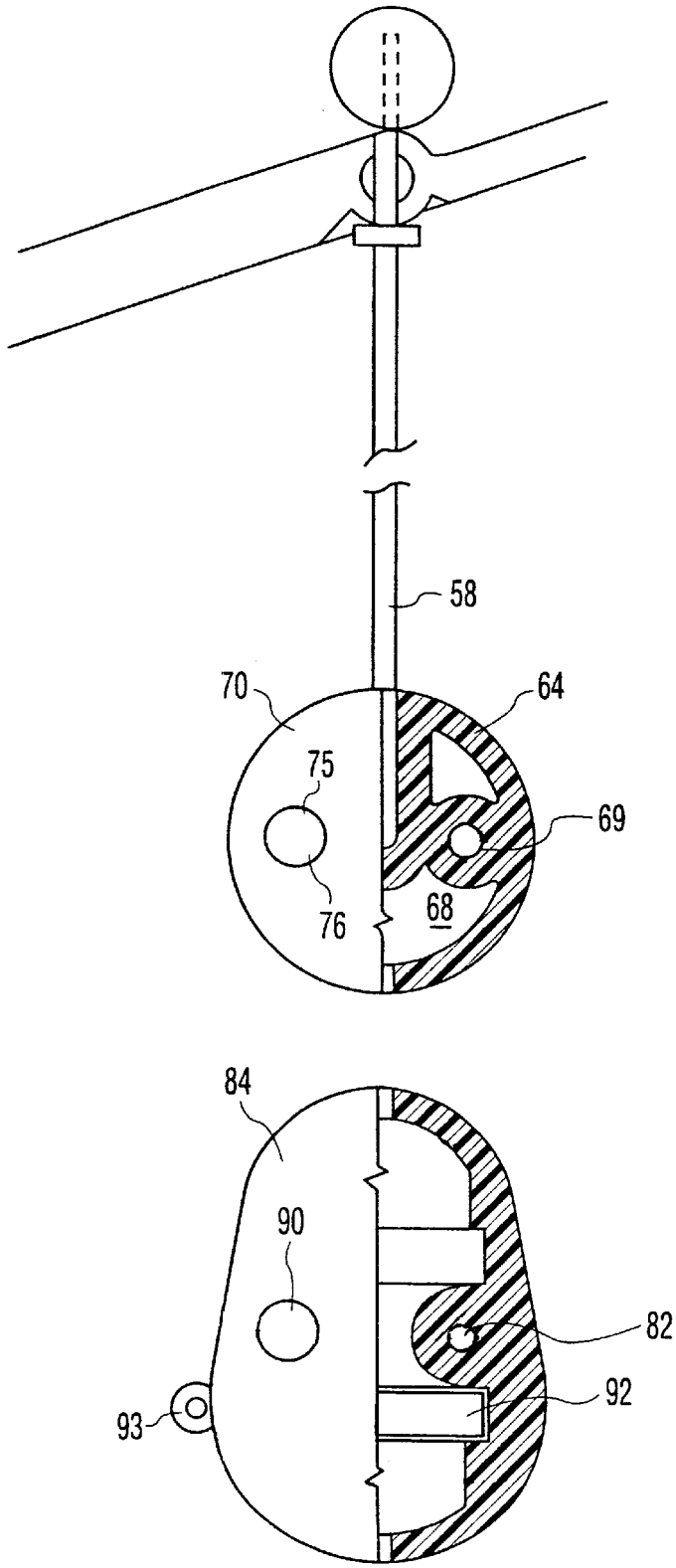
FIG. 3B is an exploded partial side section of the second construction.

FIGS. 3A and 3B depict a second construction which is more suitable for mass production, the head and body each being molded of plastic in two pieces. Here the control rod 58 has a threaded top end 59 which is received in a threaded bore of the knob 60, while the bottom end 62 is formed with an ell 62. The first half 64 and second half 70 of the head are provided with respective arcuate channels 66 and 72 which sandwich the control rod 58 therebetween, the ell 62 being received in a bore 67 in the first half 64. Mirror image recesses 68 and 73 form a cavity which captures a top knot 97 on flexible cord 96 when the two halves are fixed together, the cord 96 serving as a neck member for the finished puppet. The two halves of the head are fixed together by screws 76 having heads which are received in molded countersinks 75 in the second half 70, the threaded shanks of the screws being received in bores 69 in the first half 64.

The body is also molded in two halves 78, 84, with mirror image forward recesses 80, 86 and mirror image rear recesses 81,87. The forward recesses 80 and 86 form a cavity which captures a bottom knot 98 on the flexible cord 96, which may be molded of polyethylene or other durable yet flexible plastic. The rear recesses 81, 87 are profiled to capture and fix the position of a weight 92, which as shown may be disc shaped. The two halves of the body are fixed together by screws 90 having heads which are received in molded countersinks 89 in the second half 84, while the threaded shanks of the screws are received in bores 82 in the first half 78. The eye bolt 93 is threaded into a bore in the metal weight 92, thereby provided a solid anchor for suspending the body by the second, rod. The details of the control rod, the second rod, and the control handle are the same as in FIGS. 1 and 2.

Figure 4:
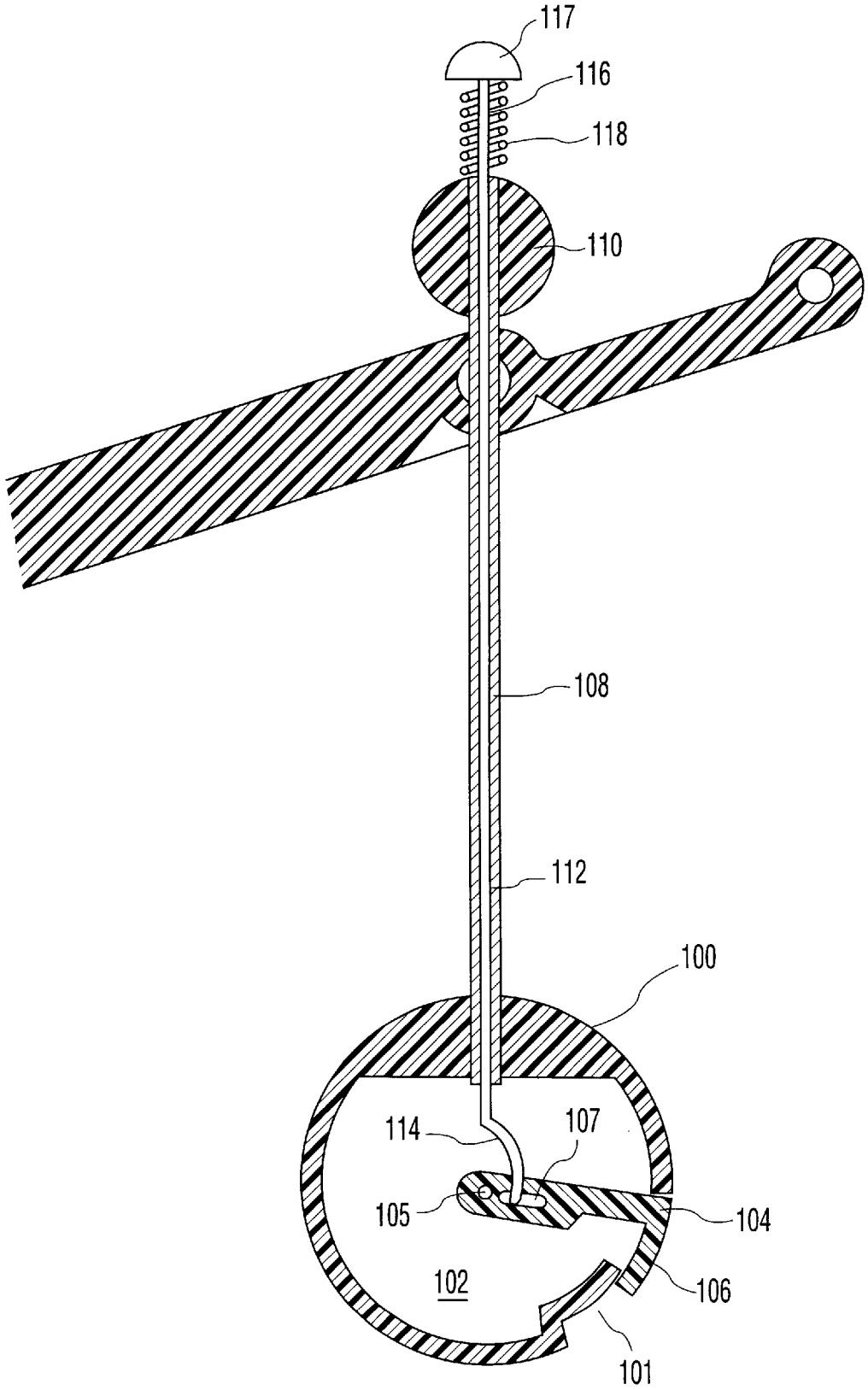
FIG. 4 is a schematic section view of a control rod with means for controlling a feature in the head.

FIG. 4 depicts a more complex embodiment with means for controlling movement of a feature in the head, such as a mouth. The head 100 has an external recess 101 and an internal cavity 102 in which a mouth member 104 is pivoted about a pin 105, the outer end of the member 104 having a lip 106 which rides downward in recess 101 for a smooth appearance. The primary control rod 108 has an upper end to which the primary knob 110 is fixed, and a lower end which is fixed in the head 100. The rod 108 has a central bore which receives a secondary control rod 112 concentrically therethrough in a sliding fit. The secondary rod 112 has a hooked lower end with a tip positioned in a slot 107 of the mouth member to effect pivoting movement about the pin 105, and an upper end 116 extending out of the primary control rod and fixed in a secondary control knob 117. A coil spring 118 fitted between the knobs 110 and 117 loads the secondary control rod upward so that the mouth remains closed until downward pressure is applied on the secondary knob 117. It should be understood that this figure is only employed to illustrate the principles of additional control, and one skilled in the art will realize how to incorporate the features of the other figures.

The foregoing is exemplary and not intended to limit the scope of the claims which follow. In particular it will be recognized that the shapes and dimensions of the various components may be varied considerably to create different animated characters.

What is claimed is:

1. Apparatus for animating a figure, said apparatus comprising a body, a head pivotably connected to said body, a control handle having a pivot axis therethrough, a control rod mounted to said handle for pivoting movement about said pivot axis, said pivot axis extending transversely through said rod, said control rod having a lower end fixed to said head, and body suspension means suspending said body pivotably from said handle, said body suspension means being connected to said handle remotely from said pivot axis and being pivotably connected to said handle remotely from said head, whereby pivoting said control rod about said pivot axis causes said head to pivot with respect to said body.

2. Apparatus as in claim 1 wherein said head is mounted for universal movement with respect to said body, and said rod is mounted for rotation with respect to said control handle about a longitudinal rod axis which is perpendicular to said pivot axis, whereby rotating said control rod with respect to said handle about said longitudinal axis causes said head to rotate with respect to said body.

3. Apparatus as in claim 2 wherein said handle has a vertical slot and a pin extending transversely through said slot, said pin being journaled in said handle for rotation about said pivot axis, said pin having therethrough a diametric hole which receives therethrough said control rod for rotation with respect to said pin about said longitudinal axis.

4. Apparatus as in claim 1 wherein said handle has a vertical slot and a pin extending transversely through said slot, said pin being journaled in said handle for rotation about said pivot axis, said pin having therethrough a hole which receives therethrough said control rod.

5. Apparatus as in claim 1 wherein said control rod has an upper end opposite said pivot axis from said lower end, said upper end having affixed thereto a control knob to facilitate manual operation.

6. Apparatus as in claim 1 wherein said control rod is a primary control rod having a concentric bore along a longitudinal axis, said apparatus further comprising a secondary control rod received through said bore and controlling movement of a feature in said head.

7. Apparatus as in claim 6 wherein said secondary control fed controls said movement of said feature by axial movement through said bore.

8. Apparatus as in claim 7 wherein said feature is a mouth.

9. Apparatus as in claim 1 further comprising limbs connected to said body and limb suspension means suspending said limbs from said handle opposite said pivot axis from said body suspension means.

10. Apparatus as in claim 9 wherein said handle has a pair of forks from which said limbs are suspended.

11. Apparatus as in claim 10 wherein each said fork has a hole therethrough, said limb suspension means comprising a string passing through said holes and having ends fixed to respective said limbs.

12. Apparatus as in claim 1 further comprising a flexible cord which pivotably connects said head to said body.

13. Apparatus as in claim 12 wherein said head has a radial bore which receives said control rod, and a radial channel extending oppositely from said bore, said control rod being received through said bore and having a distal end in said channel, said cord being fixed to said distal end.

* * * * *